US007030726B2

(12) United States Patent
Yu

(10) Patent No.: US 7,030,726 B2
(45) Date of Patent: Apr. 18, 2006

(54) PROTECTION MECHANISM FOR SWITCHES

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/889,235

(22) Filed: Jul. 10, 2004

(65) Prior Publication Data

US 2006/0006979 A1 Jan. 12, 2006

(51) Int. Cl.
*H01H 71/16* (2006.01)

(52) U.S. Cl. ..... 337/66; 337/59

(58) Field of Classification Search ..... 337/37, 337/59, 66, 67, 70, 72, 74, 75, 126; 29/622; 200/339, 401, 553
See application file for complete search history.

(56) References Cited

U.S. PATENT DOCUMENTS 3,932,829 A * 1/1976 Ellenberger ..... 337/49
4,167,720 A 9/1979 Krasser ..... 337/60
4,937,548 A 6/1990 Sdunek ..... 337/70
5,223,813 A 6/1993 Cambreleng et al. ..... 337/66
5,262,748 A 11/1993 Tsung Mou ..... 337/66
5,451,729 A 9/1995 Onderka et al. ..... 200/18
5,539,371 A * 7/1996 Yu ..... 337/66
5,558,211 A 9/1996 Heydner et al. ..... 200/553
5,933,069 A * 8/1999 Huang ..... 337/66
6,822,179 B1 * 11/2004 Huang ..... 200/401

* cited by examiner

*Primary Examiner*—Anatoly Vortman
*Assistant Examiner*—Corey Broussard

(57) ABSTRACT

A protection mechanism for a switch device includes a pull member that has one end pivotably connected to the switch member and the other end which is a hook end for lifting the bimetallic plate to set the switch device to "OFF" status. A push member is pivotably connected to the pull member and includes a lower end which is movably engaged on an inclined surface of a block extending from an inside of the case of the switch device. The lower end of the push member may push the bimetallic plate to its "ON" status. When the bimetallic plate is deformed in an overload situation, the push member is pivoted away from the bimetallic plate in such a way that the bimetallic plate can be completely deformed.

6 Claims, 5 Drawing Sheets

(OFF)

(ON)

PROTECTION MECHANISM FOR SWITCHES

FIELD OF THE INVENTION

The present invention relates to a protection mechanism for a switch device and includes a push member which is pivotable so as not to interrupt the deformation of the bimetallic plate when there is electrical current overload.

BACKGROUND OF THE INVENTION

The conventional circuit breaker uses a fuse between the switch and the circuit so that when there is electrical overload, the fuse will first melt before the overload causes damages. However, if the fuse is not properly installed or an improper fuse is used, the overload current cannot melt the fuse and may result in a disaster. U.S. Pat. Nos. 5,262,748, 4,167,720, 4,937,548, 5,223,813, 5,451,729, and 5,558,211 disclose different types of circuit breakers which commonly include a complicated mechanism to drive the bimetallic plate which is expected to be deformed and bent when there is current overload. Nevertheless, it is noted that the bimetallic plate may not be completely deformed as desired because it is not possible to be freely deformed, and the bimetallic plate is still in contact with the terminal so that sparks may be generated and therefore cause disaster.

Therefore, it is desired to have a protection mechanism for a switch device wherein a pivotable push member pushes the bimetallic plate downward to set the switch device in an "ON" status and the push member is pivoted away form the bimetallic plate to allow the bimetallic plato to be completely deformed when there is current overload.

SUMMARY OF THE INVENTION

In accordance with an aspect of the present invention, there is provided a switch device that comprises a case having an open top for a switch member pivotably engaged therewith. A first terminal and a second terminal respectively extend through a bottom of the case. A bimetallic plate has a first end fixed to the first terminal and a first contact point is connected to a second end of the bimetallic plate. A second contact point is connected to the second terminal and located beneath the first contact point. A protection mechanism includes a pull member which has an upper end thereof pivotably connected to the connection port of the switch member. A second end of the bimetallic plate is located above a lower hook end of the pull member so that the bimetallic plate can be lifted by the pull member. A push member is located above the bimetallic plate and pivotably connected to the pull member. The push member is in contact with the second end of the bimetallic plate at an angle when the switch member is pivoted to "ON" status.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
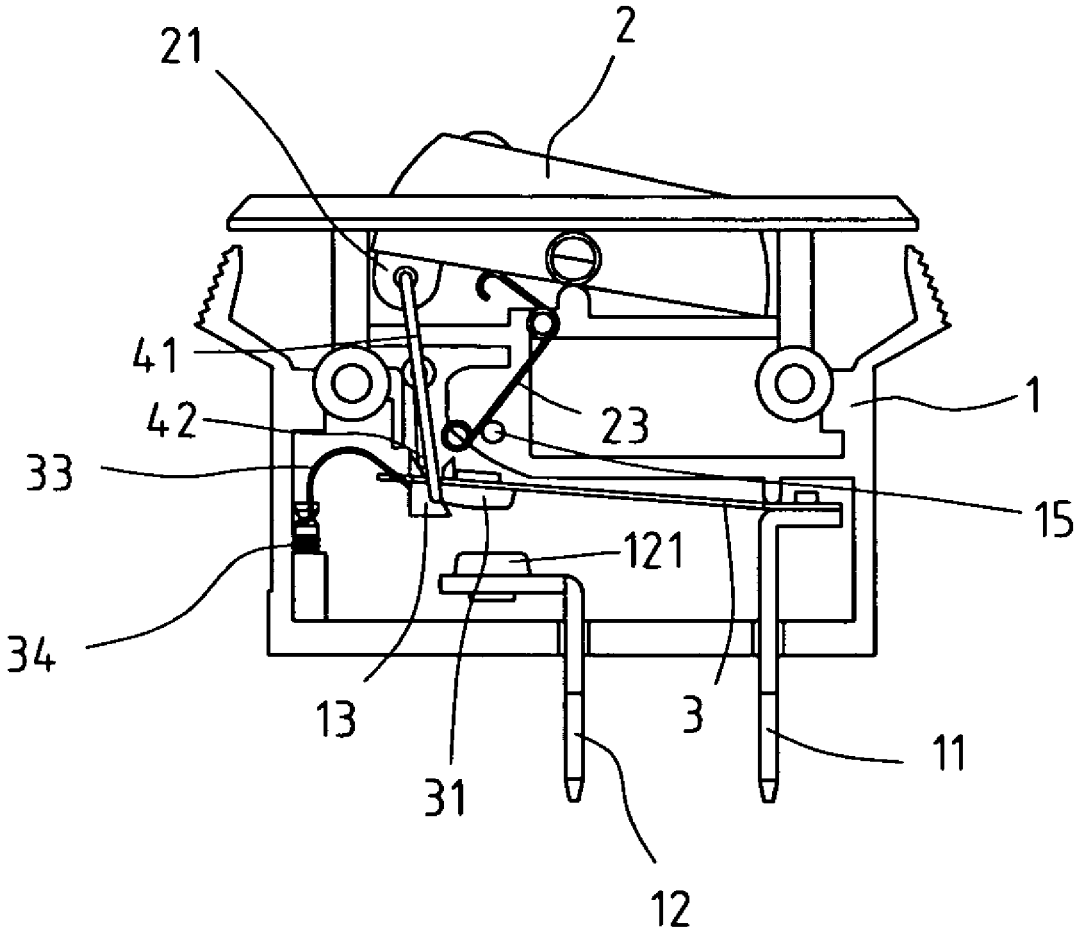
FIG. 1 shows an "OFF" status of a switch device of the present invention.
Figure 2:
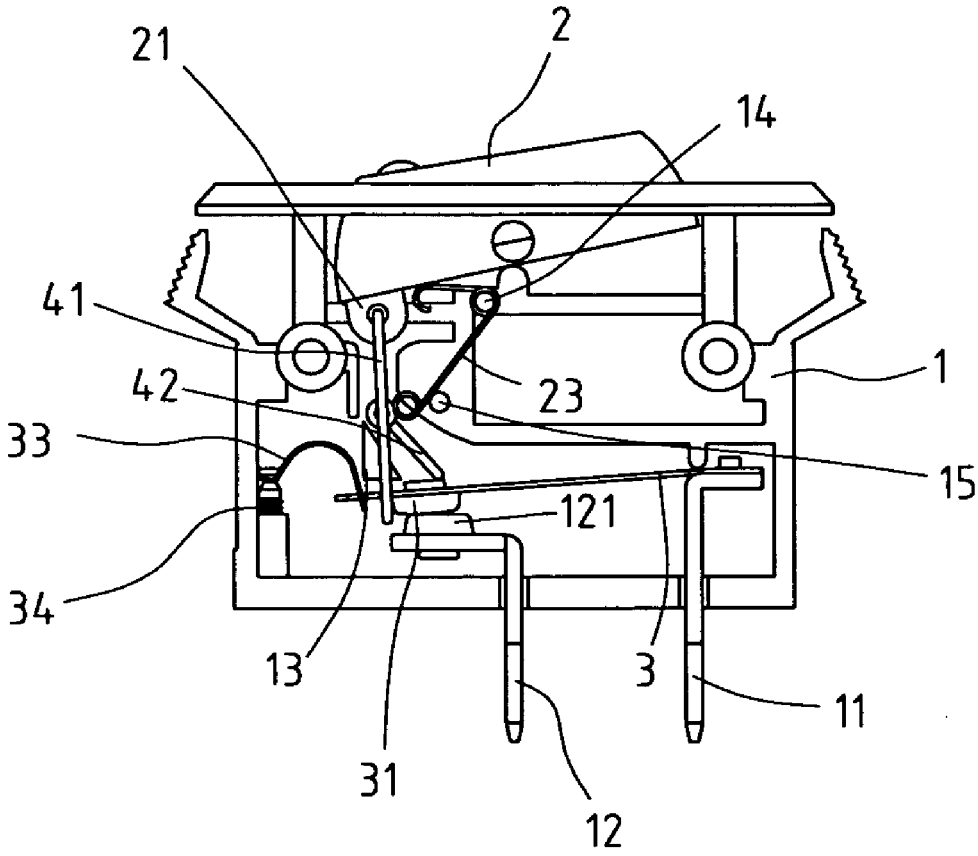
FIG. 2 shows an "ON" status of the switch device of the present invention.
Figure 5:
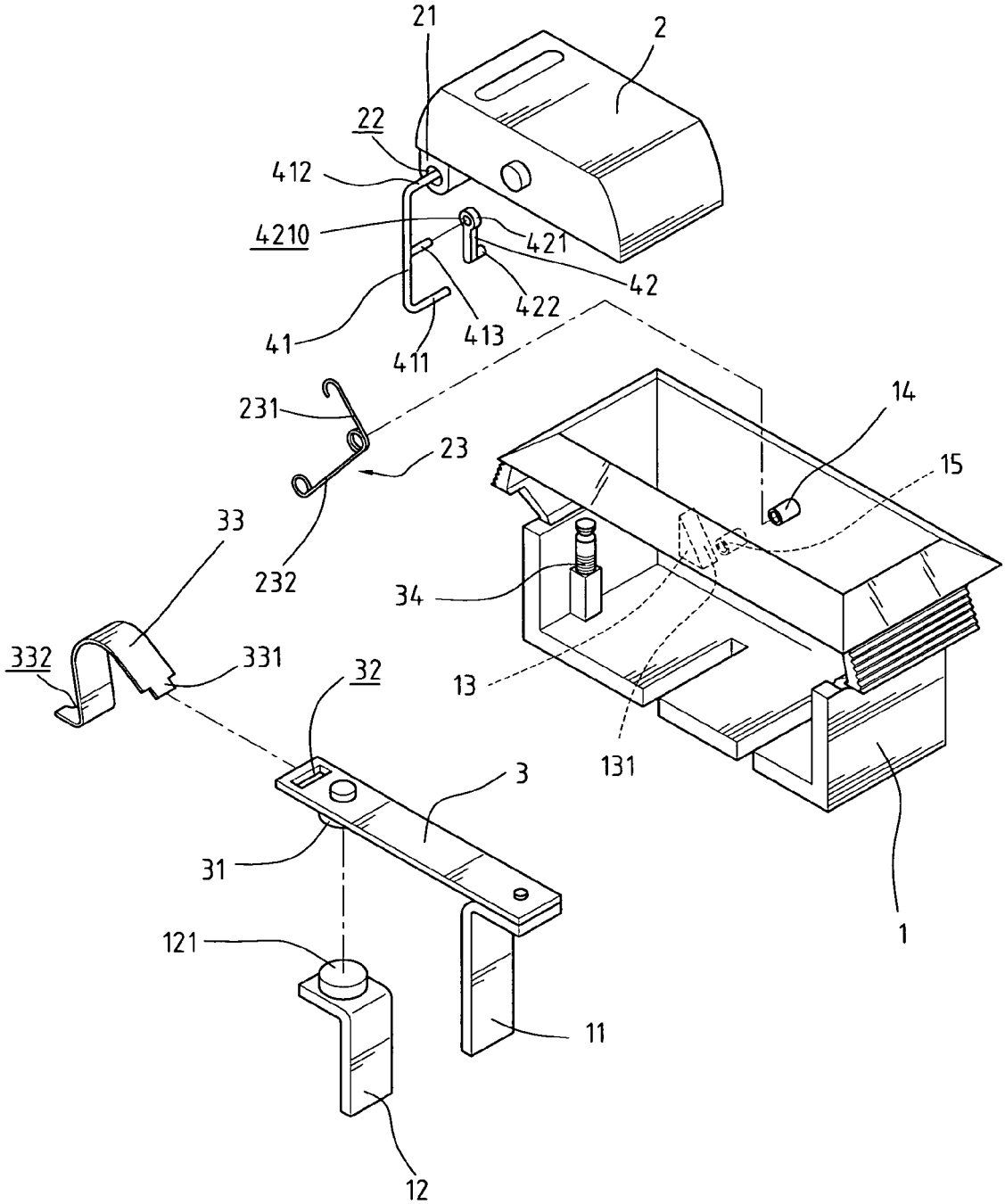
FIG. 5 is an exploded view showing a protection mechanism of the present invention.

Referring to the drawings and in particular FIGS. 1, 2, and 5, a switch device comprises a case 1 having an open top and a switch member 2 is pivotably engaged with the open top of the case 1 so as to be pushed either one of two ends thereof. A connection port 21 is connected to an underside of the switch member 2 and includes a hole 22. A first terminal 11 and a second terminal 12 respectively extend through a bottom of the case 1. A bimetallic plate 3 has a first end fixed to the first terminal 11 and a first contact point 31 is connected to a second end of the bimetallic plate 3. A second contact point 121 is connected to the second terminal 12 and located beneath the first contact point 31. A block 13 extends from an inside thereof and has an inclined surface 131. A first protrusion 14 and a second protrusion 15 respective extend from the inside of the case 1.

A protection mechanism including a pull member 41, which has a first rod 412 on an upper end thereof and the first rod 412 is pivotably inserted in the hole 22 in the connection port 21 of the switch member 2. A lower hook end 411 is connected to the lower end of the pull member 41 and the second end of the bimetallic plate 3 is located above the lower hook end 411 of the pull member 41. A push member 42 has a ring 421 located at a top end thereof and the pull member 41 includes a second rod 413 located between the first rod 412 and the lower hook end 411, such that the second rod 413 is inserted through a hole 4210 of the ring 421 of the push member 42. The push member 42 is located above the bimetallic plate 3 and includes an extension portion 422 at a lower end thereof. The extension portion 422 is movably engaged with the inclined surface 131 of the block 13.

A torsion spring 23 has a circle portion at an intermediate portion thereof which is mounted to the first protrusion 14. A first end 231 of the torsion spring 23 biases against the underside of the switch member 2 and a second end 232 of the torsion spring 23 contacts the second protrusion 15 so that the first end 231 of the torsion spring 23 provides an upward force to the underside of the switch member 2 to keep the switch member 2 at its "OFF" status A base is connected to an inside of the case 1 and an adjusting bolt 34 is threadedly connected to the base. A curve flexible plate 33 has a notch 332 defined in a first end thereof and the adjusting bolt 34 is engaged with the notch 332. A second end of the flexible plate 33 includes a tongue 331 that is engaged with a through hole 32 of the second end of the bimetallic plate 3. The flexible plate 33 provides a force to assist the deformation of the bimetallic plate 3.

When pressing the right end of the switch member 2 as shown in FIG. 1, the lower hook end 411 lifts the second end of the bimetallic plate 3 so that the first and second contact points 31, 121 are separated, and the switch device is set to "OFF" status. As shown in FIG. 2, when pressing the left end of the switch member 2, the push member 42 is lowered and pushes the second end of the bimetallic plate 3 so that the first and second contact points 31, 121 are in contact with each other, and the switch device is set to "ON" status.

Figure 3:
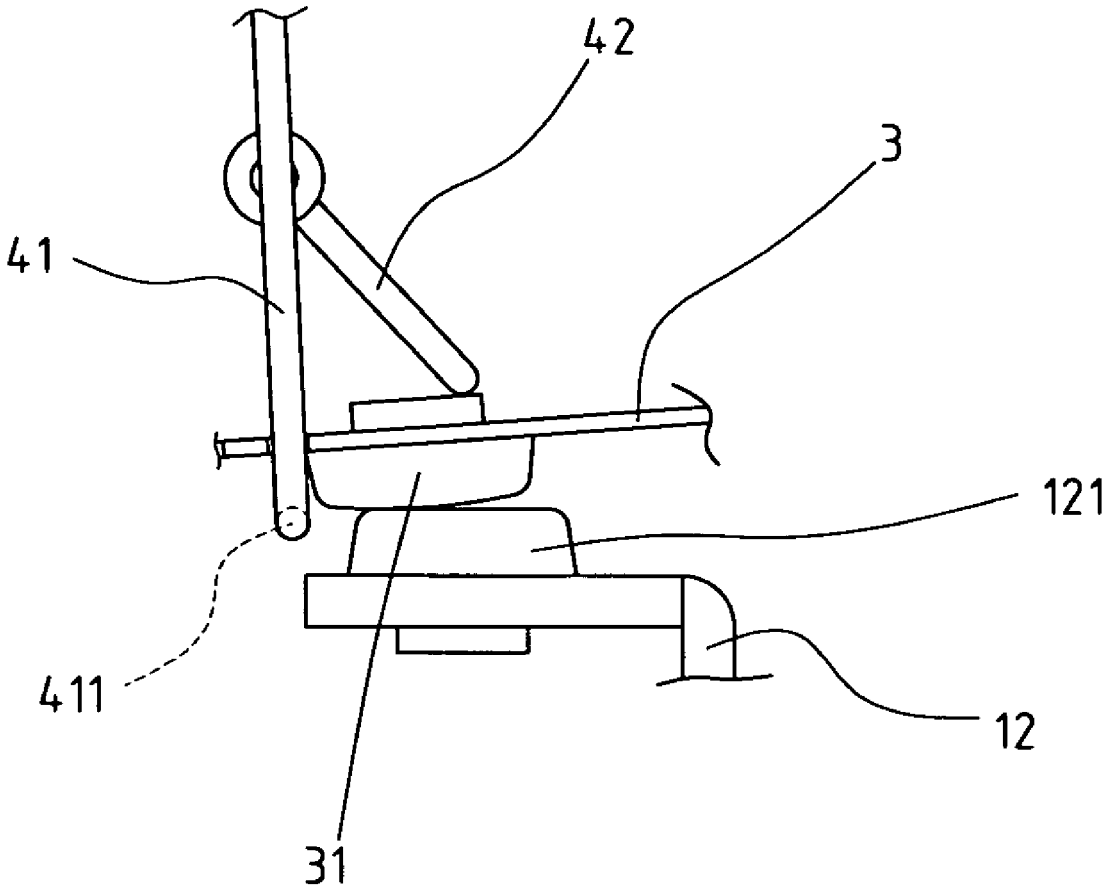
FIG. 3 shows a push member in contact with a second end of the bimetallic plate at a sharp angle.
Figure 4:
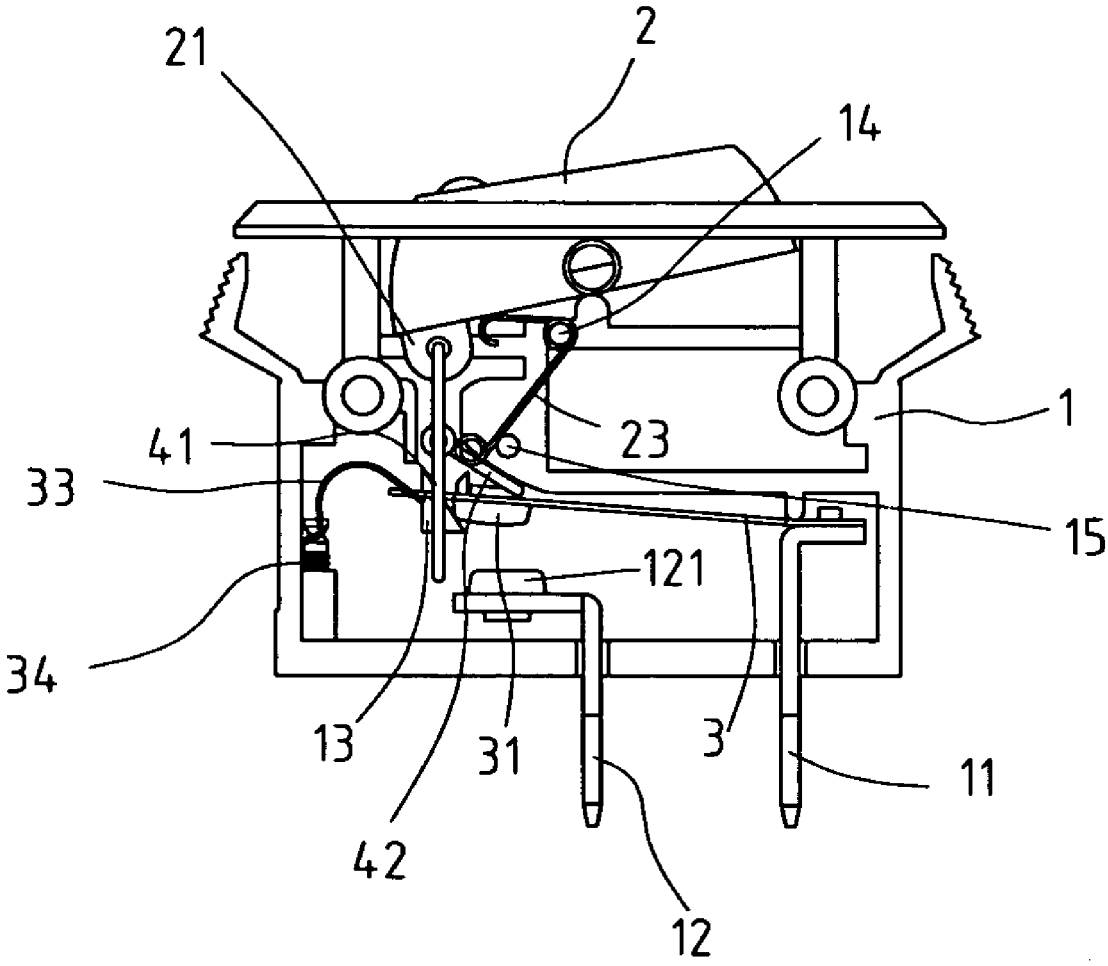
FIG. 4 shows the bimetallic plate deformed upward and the push member pivoted to allow the bimetallic plate to be completely deformed when there is electrical current overload.

As shown in FIGS. 3 and 4, when there is electrical current overload while the switch device is in "ON" status, the second end of the bimetallic plate 3 is deformed upward and hits the extension portion 422. It is noted tat the push member 42 is in contact with the second end of the bimetallic plate 3 at a sharp angle so chat the upward deformation of the bimetallic plate 3 pivots the push member 42 counter clockwise and the push member 42 does not interrupt the deformation of the bimetallic plate 3.

While we have shown and described the embodiment in accordance with the present invention, it should be clear to those skilled in the art that further embodiments may be made without departing from the scope of the present invention.

What is claimed is:

1. A switch device comprising:

a case having an open top and a switch member pivotably engaged with the open top of the case, a connection port connected to the switch member;

a first terminal and a second terminal respectively extending through a bottom of the case, a bimetallic plate having a first end fixed to the first terminal and a first contact point connected to a second end of the bimetallic plate, a second contact point connected to the second terminal and located beneath the first contact point; and a protection mechanism including a pull member which has a first rod at an upper end thereof pivotably connected to a hole in the connection port of the switch member, the second end of the bimetallic plate located above a lower hook end of the pull member, a push member located above the bimetallic plate and pivotably connected to the pull member, the push member being in contact with the second end of the bimetallic plate at an angle when the switch member is pivoted to "ON" status;

wherein the push member has a ring located at a top end thereof, and a second rod of the pull member is inserted through a hole of the ring of the push member.

2. The device as claimed in claim 1, wherein the case includes a black extending from an inside thereof and having an inclined surface, the push member including an extension portion at a lower end thereof and the extension portion movably engaged with the inclined surface of the block.

3. The device as claimed in claim 1 further comprising a torsion spring which has a circle portion at an intermediate portion thereof and mounted to a first protrusion extending from an inside of the ease, a first end of the torsion spring biased against an underside of the switch member and a second end of the torsion spring contacting a second protrusion extending from the inside of the ease so that the first end of the torsion spring provides a upward force to the underside of the switch member.

4. The device as claimed in claim 1, wherein a curve flexible plate has a first end fixed to an inside of the case and a second end of the flexible plate is connected to the second end of the bimetallic plate.

5. The device as claimed in claim 4, wherein the second end of the bimetallic plate has a through hole and the second end of the flexible plate includes a tongue that is securely engaged with the through hole.

6. The device as claimed in claim 4, wherein an adjusting bolt is threadedly connected to a base on an inside of the case and the first end of the flexible plate has a notch with which the adjusting bolt is engaged.

* * * * *